United States Patent [19]

Stahnke

[11] 4,450,749

[45] May 29, 1984

[54] METHOD AND APPARATUS FOR RECORDING AND REPRODUCING PEDALLING EFFECTS IN A PIANO PERFORMANCE

[76] Inventor: Wayne L. Stahnke, 11434 McCune Ave., Los Angeles, Calif. 90066

[21] Appl. No.: 371,306

[22] Filed: Apr. 23, 1982

[51] Int. Cl.[3] ..... G10G 3/04

[52] U.S. Cl. ..... 84/462

[58] Field of Search ..... 84/13, 462, 463

[56] References Cited

U.S. PATENT DOCUMENTS 4,307,648 12/1981 Stahnke ..... 84/462

4,351,221 9/1982 Starnes et al. ..... 84/462

*Primary Examiner*—Donald A. Griffin

*Attorney, Agent, or Firm*—Ralph B. Pastoriza

[57] ABSTRACT

A grand piano or a vertical piano is equipped with a proportional sensor and a proportional actuator, both connected to the damper lifter tray (in a grand piano) or damper actuator bar (in a vertical piano). During a piano performance the instantaneous position of the lifter tray or actuator bar as the case may be is sensed and recorded, in addition to the keyboard activity. At a later time when the performance is reproduced, the actuator positions the lifter tray or actuator bar, as the case may be, in such a way that the dampers are positioned in an imitation of the way they were positioned during the original performance. The result is that subtle pedalling effects formerly lost are accurately reproduced. The method and apparatus of the invention apply equally well to the soft pedal as to the sustaining pedal, both of which affect the vibrating characteristics of the piano strings.

19 Claims, 5 Drawing Figures

METHOD AND APPARATUS FOR RECORDING AND REPRODUCING PEDALLING EFFECTS IN A PIANO PERFORMANCE

FIELD OF THE INVENTION

This invention relates to improvements in recording and reproducing piano music electro-mechanically, and more particularly to an improved method and apparatus for recording and reproducing the pedalling effects in a piano performance.

BACKGROUND OF THE INVENTION

It has been known for many years to record piano performances and reproduce the same by sensing the key and pedal motions during a performance, and subsequently recreating the performance by moving the keys and pedals mechanically in imitation of the motions that occurred during the original performance. In earlier versions, the piano roll constituted the recording medium and effected mechanical operation through pneumatic control during playback. More recently, magnetic tape has been used as the recording medium and appropriate solenoids or equivalent actuators, responsive to the recorded signal used to mechanically play the piano.

While mechanical reproduction is capable of a high degree of realism, such reproductions by presently available means have been marred by subtle, though nonetheless disturbing, differences between the original performance and the reproduced performance. These differences tend to be more marked during lyrical, expressive passages than during fast-moving, highly technical ones. A large part of the discrepancy can be attributed to the way in which the pedalling has been sensed and reproduced.

In the prior art the pedals are treated as devices that are either on or off. This operation is frequently referred to as "bang-bang" operation. The actuators for the pedal functions have included devices such as dashpots to insure that the actuation does not occur too quickly, which overly rapid movement would produce unacceptable noise, but no attempt has been made to reproduce pedalling proportionately. I have discovered that the "bang-bang" approach to pedalling is responsible for much of the artificial, mechanical quality of many reproduced performances.

With respect to the foregoing, it can be appreciated that in the case of the sustaining pedal the performing artist might drop the dampers on the strings for only a short time, not sufficient to effect complete damping and then raise the dampers slightly to result in a softer sustaining note or notes. In fact, the dampers might even be maintained in a very light contact with the piano strings by appropriate positioning of the sustaining pedal. These pedalling nuances cannot be reproduced by the "bang-bang" present day arrangements, wherein the damper is either on the strings or fully lifted from the strings.

In the case of the soft pedal wherein the key hammers are shifted relative to the strings so that when the hammer hits the strings, a softer tone results, again subtle effects can be reproduced by controlling the degree of "shift" of the pedal. For example, in the case of a grand piano, the soft pedal functions to shift the entire piano key frame relative to the strings by a small amount normally corresponding to the distance between the three strings making up a note. As a result, the hammer will only strike two of the three strings, resulting in the softer tone. However, an artistic performer may wish to provide subtler effects, which can be accomplished by effecting only a partial shifting of the piano key frame such that one of the strings may be engaged only lightly by the hammer. Also, it will be appreciated that grooves will tend to form in the felt-engaging portion of the hammer after prolonged use, so that if only a partial shifting of the key frame occurs, fresh felt will be striking the keys again affecting the vibration of the piano strings.

BRIEF DESCRIPTION OF THE PRESENT INVENTION

With all of the foregoing considerations in mind, the present invention contemplates a method and apparatus for recording and reproducing pedalling effects in a piano performance, not capable of being recorded and reproduced by conventional systems presently available.

More particularly, a piano is provided in which the pedal is connected through trapwork to move a member through a given distance to affect the vibrating characteristics of the piano strings, all as is present in conventional pianos. In the case of a grand piano, the member moved is the damper lifter tray when the sustaining pedal is used or the piano key frame, when the soft pedal is used. In the case of a vertical piano, the member is the piano damper actuator bar when the sustaining pedal is used and the piano hammer rail when the soft pedal is used.

In accord with basic method steps of the present invention, the positions of the member are transduced as it moves through a given distance into an electrical signal whose value varies as a function of said positions. This electrical signal is recorded on a recording medium; for example, magnetic tape.

In the producing of pedalling effects, the method steps include playing back an electrical signal from a recording medium whose value varies as a function of desired positions of the member within said given distance; deriving a command signal from this electrical signal played back from the recording medium; and transducing the command signal into movements of the member. When the sustaining pedal is used, the movement of the dampers will be precisely controlled in accord with the electrical signal and in the case of the soft pedal, the movement of the key hammers will be controlled in accord with the electrical signal.

Appropriate apparatus for carrying out the method includes transducer means such as a potentiometer, recording equipment, playback equipment, and actuator for mechanically moving the member controlled by the pedalling in accord with a command signal, together with appropriate electrical circuitry for deriving the command signal from a recorded electrical signal of the performance.

Since, in effect, every intermediate position of the piano pedals can be recorded in the form of an electrical signal in accord with the present invention, these same intermediate positions can be reproduced thereby providing the heretofore referred-to nuances in pedalling.

BRIEF DESCRIPTION OF THE DRAWINGS

A better understanding of this invention will be had by now referring to the accompanying drawings in which.

DETAILED DESCRIPTION OF THE INVENTION

Figures 1, 2:
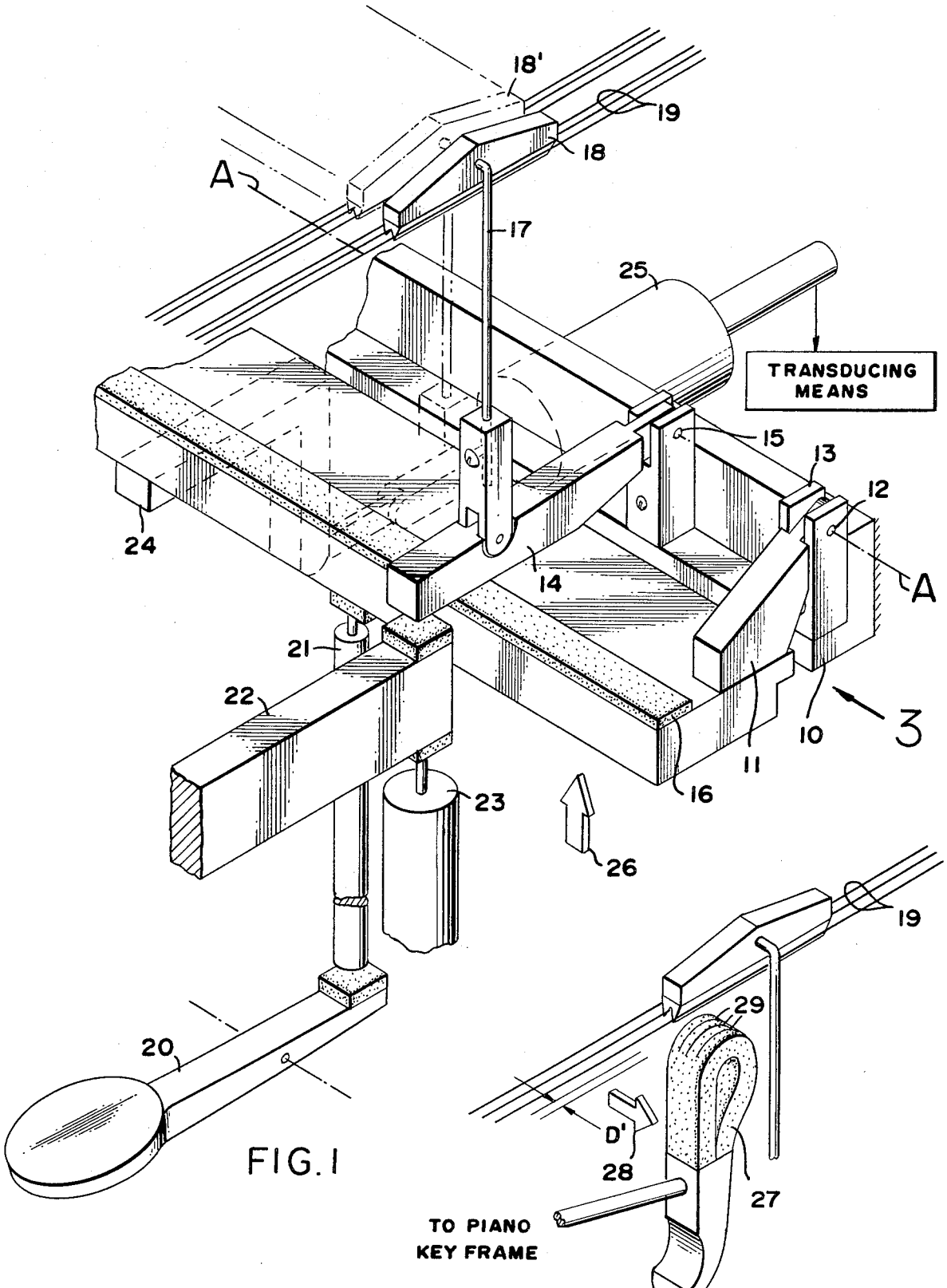
FIG. 1 is a fragmentary perspective view, schematic in nature, illustrating basic piano components in combination with appropriate means for carrying out the method of this invention.
FIG. 2 is another fragmentary perspective view of additional piano components, useful in explaining features of the present invention.

Referring first to the lower right-hand portion of FIG. 1, there is shown a fixed rail 10 constituting part of a piano such as grand piano. A damper lifter tray 11, in turn, is pivoted as at 12 on flange 13 of the rail 10, for swinging movement of the tray 11 about an horizontal axis A—A. It will be understood that further mounting pivots for the lifter tray 11 are provided at the far end of the rail as well as at intermediate positions.

Shown above the damper lifter tray 11 is a damper lifter 14 pivoted on the fixed rail 10 as at 15 and arranged to be lifted upwardly about the same axis A—A by the damper lifter tray 11 when the same is rotated about the axis A—A. In this respect, there is provided a felt pad 16 which runs the entire length of the lifter tray 11 for engaging the undersides of the various damper lifters, such as the lifter 14.

The damper lifter 14 is coupled through a damper wire 17 to a damper 18 shown engaging piano strings 19. It will be understood that there are provided several damper lifters similar to 14 with cooperating dampers similar to 18 pivoted for movement about the axis A—A along the fixed rail 10, there being associated a damper with most of the piano keys. One such additional damper is shown at phantom lines 18'.

In the particular example of FIG. 1, there is illustrated to the lower left the sustaining pedal 20 for the piano coupled through appropriate trapwork 21 to the underside of the damper lifter tray 11. The arrangement is such that when the pedal 20 is depressed, it will rotate about a pivotal mounting to lift through the medium of the trapwork 21 the tray 11; that is, cause it to rotate about the pivot axis A—A on the fixed rail 10 so as to lift the damper lifter 14 and thereby raise the damper 18 from the strings 19. Since the tray 11 extends under all of the damper lifters, all will be lifted simultaneously.

In addition, it will be understood that the damper lifter associated with each individual piano key can be lifted from the corresponding strings independently of the others. Towards this end, there is illustrated a portion 22 of one piano key positioned beneath the extending end of the damper lifter 14. Where an automatic player piano is involved as in the present case, there would be provided appropriate actuating means such as the solenoid coil 23 for actuating the key 22 in response to recorded signals.

Thus far, everything described in FIG. 1 is conventional in recording and reproducing pianos. However, in these pianos as described heretofore, the tray 11 which constitutes a movable member responsive to operation of the pedal 20 has its movement controlled in playback by a solenoid and which either removes the dampers, such as the damper 18, from the strings by lifting the tray 11 to a raised position or maintains the damper 18 on the strings so long as a note is not being played by dropping the tray 11. There is no means for supporting or moving the tray 11 to an intermediate position.

In accord with the present invention, the damper lifter tray 11 is provided with an angle bracket shown at the far end of FIG. 1 at 24 on its underside. The depending leg of this bracket, in turn, is arranged to be moved by an actuator 25 which may take the form of a solenoid. In the particular embodiment illustrated, there is schematically indicated by the block a transducing means connected to the plunger of the solenoid 25 so that the movement of the tray 11 as a consequence of movement of the solenoid plunger will result in operation of the transducer means. The referred-to movement of the damper lifter tray is indicated by the arrow 26 in FIG. 1.

Before describing in further detail the foregoing, it will be recalled that there would normally be provided a series of dampers 18 extending horizontally in a direction parallel to the fixed rail 10 and damper lifter tray 11. Similarly, there would be provided a series of hammers for the various sets of strings, corresponding to the number of piano keys and positioned normally beneath the forward portions of the dampers beneath the strings. These hammers are not illustrated in FIG. 1 to avoid obscuring the drawing. However, one such hammer is illustrated in FIG. 2.

With specific reference to FIG. 2, the illustrated hammer is shown at 27 and is connected to the piano key frame. When the soft pedal as opposed to the sustaining pedal 20 of FIG. 1 is operated, the entire piano key frame in a grand piano is moved to the right as indicated by the arrow 28 a very short distance D'. This distance D' corresponds to the distance between strings making up the set of three strings for each note.

In FIG. 2, the felt tipping at the top of the hammer 27 is shown with grooves 29 which have resulted from repeated striking of the three strings by the hammer felt. When the soft pedal is depressed, it shifts the hammers horizontally through the distance D' corresponding to the distance between the grooves 29 so that only two of the set of three strings will be struck by the hammer and thus a softer tone will result. However, it can be appreciated that if the hammers are not moved through the complete distance D' but only through a part of that distance, then fresh portions of the felt between the grooves would strike the strings giving rise to a different tone quality. In other words, the vibrations of the strings can be affected by the degree of movement of the piano key frame which in turn is controlled by the soft pedal.

In the case of a vertical piano, the hammers are controlled by a hammer rail whereas the dampers are controlled by a damper actuator bar as opposed to the damper lifter tray.

In this specification and in the claims, the particular member to be moved by operation of a pedal is simply referred to as a member. Thus, in one example, the tray 11 would be member where the sustaining pedal is operated in a grand piano. Also, the piano key frame would be a member moved by operation of the soft pedal. Whether the member moved is the tray, the piano key frame, the actuator bar, or the hammer rail, the actuator 25 and associated transducing means together with other controls all operate in precisely the same way to effect a recording and reproduction of the movement of the member.

For purposes of illustration, the specific example of FIG. 1 using a sustaining pedal with the movable member constituting the damper lifter tray 11 will be described.

Figure 3:
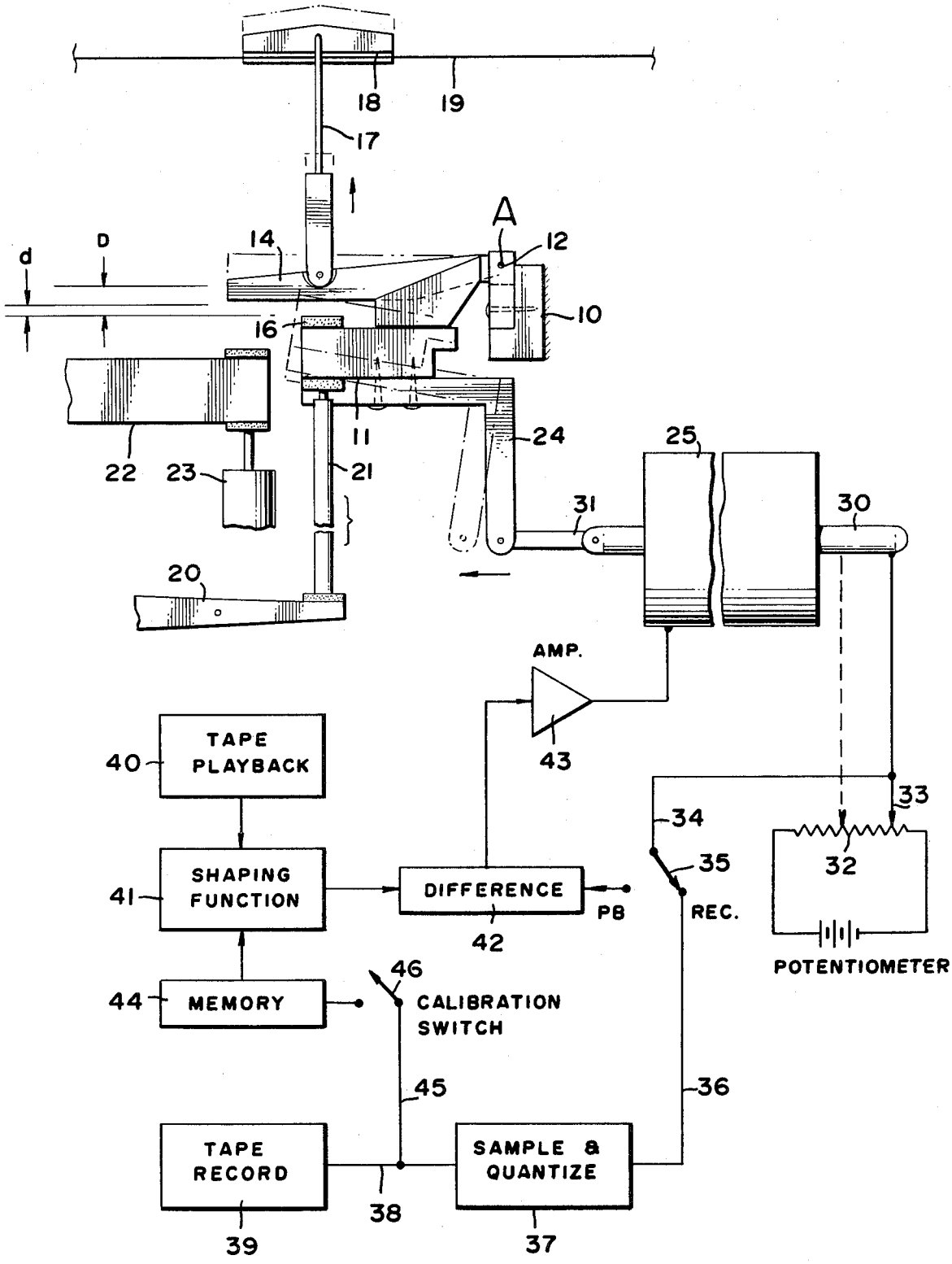
FIG. 3 is a side elevational view of the various components of the invention, looking in the direction of the arrow 3 of FIG. 1.

Referring now to FIG. 3, assume that a piano player is operating the sustaining pedal 20 shown in FIG. 1. Upon depression of the pedal 20, the tray 11 will be urged upwardly through the trapwork 21, the movement taking place about the pivot 12, that is, the axis A, to lift the damper 18 from the strings 19. It should be noted that this action, which is depicted by the phantom lines has two distinct phases. First, there is some lost motion of the tray 11 in moving the felt pad 16 upwardly until such time as this pad actually physically engages the underside of the damper lifter 14. This lost motion distance is indicated by the letter d. After engagement takes place, continued depression of the pedal 20 further urges the tray 11 upwardly through the trapwork 21 to then lift by way of the damper wire 17 the damper 18 from the strings 19. The lifted phantom line position of the damper is shown and the total overall distance moved by the tray 11 is indicated by the letter D.

The above described movements of the tray 11 about the pivot 12 are transferred by way of the bracket 24 to the solenoid plunger 30 by way of connecting link 31. Thus, the solenoid plunger 30 will move proportionately to movement of the lifting tray 11.

The transducer means described briefly in FIG. 1 is shown in FIG. 3 as comprising a resistance 32 with movable contact 33. The movable contact 33 is connected directly to the plunger 30 for movement therewith.

Because of the foregoing inner connections described, it will be seen that the potentiometer constitutes a transducing means which will transduce the physical positions of the tray member 11 as it moves through the given distance D into an electrical signal whose value varies as a function of such positions. While a potentiometer is shown as this transducing means, any other equivalent transducer could be employed.

A resulting electrical signal is passed by lead 34 through a record playback switch 35 and lead 36 to a sample and quantisizing circuit indicated by block 37. For example, the block 37 might constitute an analog to digital converter. The output of the block 37 is connected through lead 38 to a tape recorder 39. Thus, the transduced movements of the damper lifter tray 11 are recorded on the tape recorder 39 by means of the potentiometer arrangement described. It should be appreciated that with respect to simply making a recording, there is no requirement for the solenoid 25. Rather, it is only necessary that the transducer be responsive to movement of the tray 11. However, since the particular piano described in FIG. 1 is also designed to reproduce the recorded piano movements, the solenoid 25 will serve as an actuator. Further, the same potentiometer 32 can be used in the playback mode to advantage as will now be described.

Assume that the tape recording in the tape recorder 39 is to be played back either on the piano of FIGS. 1 and 3 or on a similarly equipped piano, the tape itself is placed in a playback machine indicated at 40 to provide an electrical signal whose value varies as a function of desired positions of the damper lifter tray 11 within the given distance D. From this electrical signal, there is derived a command signal to operate the actuator or solenoid 25.

In the preferred embodiment illustrated in FIG. 3, this command signal is derived by first modifying the electrical signal from the tape playback 40 by an appropriate shaping signal in shaping function block 41. The modified signal is then compared in a difference circuit 42 with a new electrical signal having a value constituting a function of the achieved position of the tray member in response to the command signal to provide a difference signal. Thus, as shown in FIG. 3, the record playback switch can be placed in the playback position PB so that the signal from the potentiometer 32 passes directly into the difference circuit 42. It will be clear that the signal from potentiometer 32 is precisely a function of the actual position of the actuator plunger and thus of the actual or achieved position of the tray 11. The error signal or difference between the modified electrical signal from block 41 and the new electrical signal from the potentiometer 32 is amplified in amplifier 43 and thus constitutes the command signal to the actuator 25.

The actuator 25 responds to the signal resulting in movement of the tray which in turn operates the potentiometer 32 so that a closed loop feedback control obtains.

The purpose for the shaping function block 41 is to modify the electrical signal from the tape playback 40 by a shaping signal derived from a memory 44. In essence, this shaping signal functions to decrease errors between the achieved position of the lifting tray by the actuator and its commanded position over the errors that would occur in the absence of such shaping signal.

The shaping signal in the memory 44 itself, can be derived from an operation of the various components which lead to inaccuracies that would result in the absence of such a shaping signal. Thus, it will be noted that there is provided a lead 45 from the lead 38 at the output of the sample and quantizing block 37. By closing switch 46, and by running the sustaining pedal through its complete distance D so as to pass through every position, the resulting signal from the potentiometer 32 will be stored in the memory 44 and contain the necessary information for carrying out the shaping function.

Figure 4:
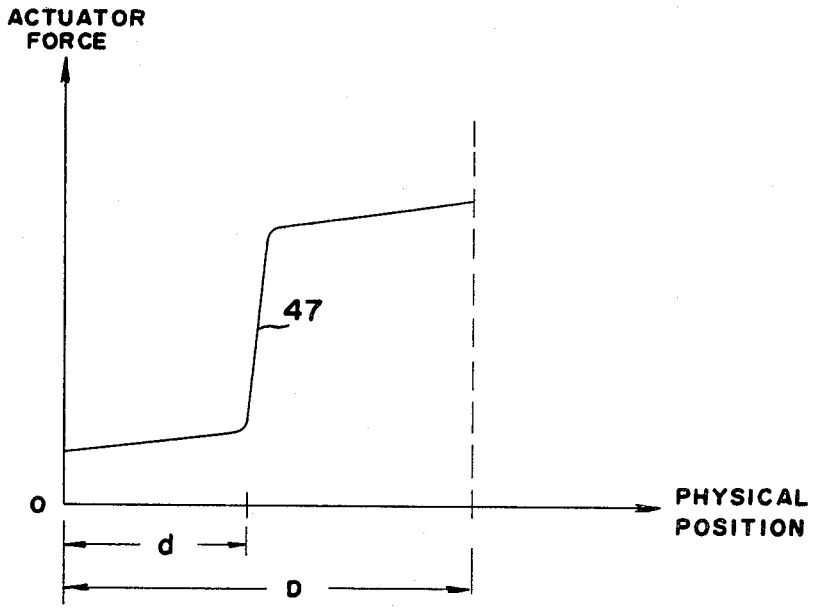
FIG. 4 is a wave form depicting the relationship between applied force and physical position characteristic of one embodiment of the invention.
Figure 5:
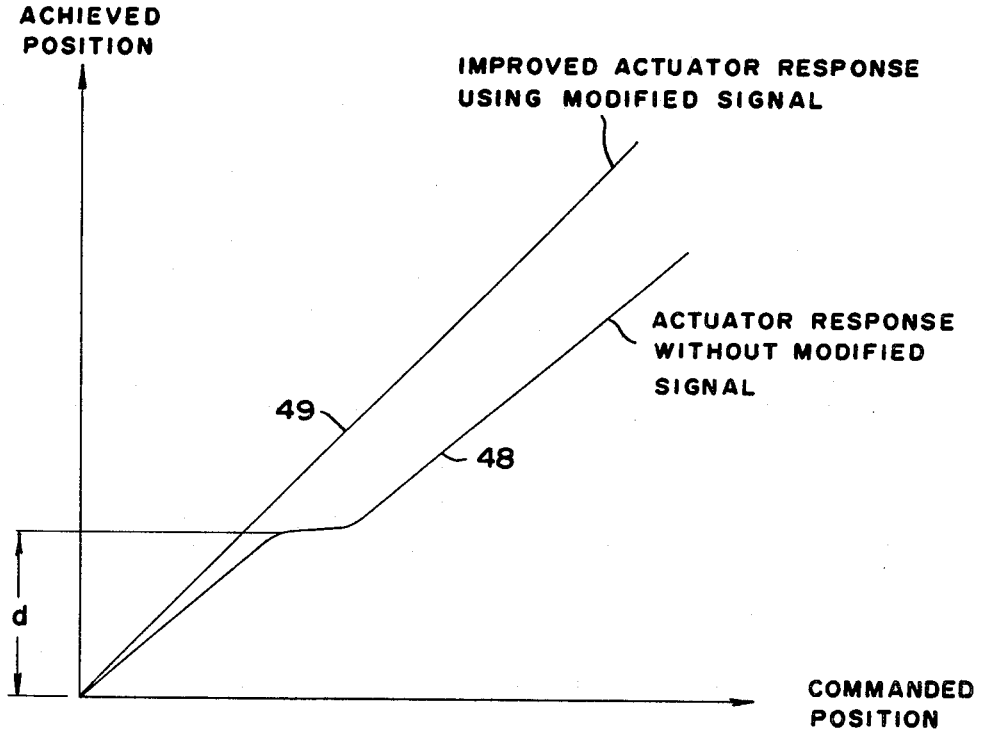
FIG. 5 shows plots indicating the relationship between an achieved position and a commanded position, useful in explaining additional features of the present invention.

The foregoing will better be understood by now referring to FIGS. 4 and 5.

Referring first to FIG. 4, the plot 47 represents the actuator force or force necessary to move the tray 11 over the given distance D. Thus, it will be noted that there is only a slight increase of force from the zero position out to the distance d which represents the lost motion or empty distance between the lifting pad 16 and underside of the damper lifter 14.

When the tray pad 16 engages the underside of the damper lifter 14, then greater force is required to lift up the damper lifter and damper 18 and this greater force is depicted by the sudden upturn of the plot 47 to a higher force during the remaining movement through the distance D.

Considering the actuator 25 itself, it will thus be evident that a driving electrical signal for the plunger must all of a sudden itself increase in power at the critical distance d so that proper movement of the tray will take place.

Because of the feedback arrangement described in FIG. 3, and because of the greater force required, there will be required a larger command signal which means that there will be required a larger error signal from the difference circuit 42. As a consequence, there is a deviation between the achieved position of the tray and the commanded position.

Referring to FIG. 5, this situation is depicted by the lines 48 and 49. The line 49 constitutes an ideal response in that the achieved position of the actuator and thus the lifting tray exactly equals the commanded position.

The line 48, on the other hand, represents the actuator response as a consequence of the feedback arrangement and in the absence of the referred to shaping function. Thus, as indicated by the line 48 as the tray passes through the lost motion distance d there will not be required a great force to lift the tray and thus only a small error signal represented by the difference between the lines 48 and 49 exists.

When the distance d is reached so that the tray must now lift the damper lifter, wire and damper greater force is required and thus a greater error signal is generated as indicated by the later portion of the curve 48.

With FIG. 5 in mind, the shaping signal essentially modifies the electrical signal from the tape playback 40 passed to the difference circuit 42 in such a manner that the line 48 is modified to coincide essentially with the line 49 so that the achieved position corresponds substantially to the commanded position.

In fact, the above correspondence can be made exact. However, as the components are used, because of packing of the felt lifting pads, changes in friction of the pivot joints, and the like, the specific shaping signal will not always result in proper correspondence. It is for this reason that there is provided the calibrating switch 46 in FIG. 3 so that a sampling of the signal/position characteristics of the pedal through the distance D can be quickly introduced into the memory 44 prior to reproducing the piano composition.

From all of the foregoing it can now be appreciated that the present invention has greatly enhanced the recording and reproduction of piano performances mechanically on pianos by providing information in the recorded signal relating to subtle pedalling effects which information can be reproduced precisely all as described and without interferance with normal pedal operation.

I claim:

1. A method of recording pedalling effects in a piano performance wherein the pedal of a piano is connected through trapwork to move a member through a given distance to affect the vibrating characteristics of the piano strings, said method including the steps of:

(a) transducing the positions of said member as it moves through said given distance into an electrical signal whose value varies as a function of said positions; and (b) recording said electrical signal on a recording medium.

2. A method of producing pedalling effects in a piano wherein the pedal of said piano is connected through trapwork to move a member through a given distance to affect the vibrating characteristics of the piano strings, said method including the steps of:

(a) playing back an electrical signal from a recording medium whose value varies as a function of desired positions of said member within said given distance, (b) deriving a command signal from said electrical signal played back from said recording medium; and (c) transducing said command signal into movements of said member to positions corresponding to the values of said electrical signal.

3. The method of claim 2, in which said electrical signal used for producing said pedalling effects is the same electrical signal recorded by the method of claim 1, whereby the pedalling effects in a piano performance may be recorded and subsequently reproduced.

4. The method of claim 2, in which the step of deriving a command signal from said electrical signal includes comparing the electrical signal played back from said recording medium with a new electrical signal having a value constituting a function of the achieved position of said member in response to said command signal to provide a difference signal; and making said command signal a function of said difference signal whereby closed loop feedback control obtains.

5. The method of claim 2, in which the step of deriving a command signal from said electrical signal includes modifying said electrical signal played back from said recording medium by a shaping function to provide a modified signal; and making said command signal a function of said modified signal whereby more accurate positioning of said member in response to said command signal obtains than would be the case in the absence of said shaping function.

6. An apparatus for recording pedalling effects in a piano performance wherein the pedal of a piano is connected through trapwork to move a member through a given distance to affect the vibrating characteristics of the piano strings, said apparatus including, in combination:

(a) a transducing means coupled to said member for generating an electrical signal whose value varies as a function of the positions of said member as it moves through said given distance; and (b) a recording means including a recording medium connected to receive and record said electrical signal on said recording medium.

7. An apparatus according to claim 6, in which said transducing means comprises a potentiometer having its movable contact coupled to said member.

8. An apparatus for producing pedalling effects in a piano wherein the pedal of said piano is connected through trapwork to move a member through a given distance to affect the vibrating characteristics of the piano strings, said apparatus including, in combination:

(a) means responsive to an electrical signal from a recording medium whose value varies as a function of desired positions of said member within said given distance for generating a command signal; and (b) an actuator on said piano coupled to said member and responsive to said command signal to move said member to positions corresponding to the values of said electrical signal.

9. An apparatus according to claim 8, in which said electrical signal used for producing said pedalling effects is the same electrical signal recorded by the apparatus of claim 6.

10. An apparatus according to claim 9, in which said pedal is the sustaining pedal for said piano and said member moves the piano string dampers towards and away from the piano strings.

11. An apparatus according to claim 10 in which said piano is a grand piano and said member is the piano damper lifter tray.

12. An apparatus according to claim 10, in which said piano is a vertical piano and said member is the piano damper actuator bar.

13. An apparatus according to claim 9, in which said pedal is the soft pedal for said piano and said member moves the piano string hammers relatively to the strings.

14. An apparatus according to claim 13, in which said piano is a grand piano and said member is the piano key frame.

15. An apparatus according to claim 13, in which said piano is a vertical piano and said member is the piano hammer rail.

16. An apparatus according to claim 8, in which said means for generating a command signal includes transducing means coupled to said member for providing a new electrical signal having a value constituting a function of the achieved position of said member in response to movement by said actuator; a comparator connected to receive said electrical signal played back from said recording medium and said new electrical signal to provide a difference signal; and amplifying means for amplifying said difference signal to provide said command signal.

17. An apparatus according to claim 16, in which said transducing means comprises a potentiometer having its movable contact coupled to said member.

18. An apparatus according to claim 17, in which said actuator is a solenoid, having a plunger coupled to said member.

19. An apparatus according to claim 8, in which said means for generating a command signal includes means for providing a shaping signal; and means for modifying said electrical signal played back from said recording medium by said shaping signal to provide said command signal, said shaping signal functioning to decrease errors between the achieved position of said member by said actuator and its commanded position over those errors that would occur in the absence of such shaping signal.

* * * * *